US005549046A

United States Patent [19]

Widner et al.

[11] Patent Number: 5,549,046

[45] Date of Patent: Aug. 27, 1996

[54] PLASMA GENERATOR FOR ELECTROTHERMAL GUN CARTRIDGE

[75] Inventors: Melvin M. Widner, Rochester Hills, Mich.; Michael Raleigh, Alexandria, Va.; Yeshayahu S. A. Goldstein, Gaithersburg; Joseph R. Greig, Greenbelt, both of Md.

[73] Assignee: General Dynamics Land Systems, Inc., Sterling Heights, Mich.

[21] Appl. No.: 238,433

[22] Filed: May 5, 1994

[51] Int. Cl.[6] ..... F42B 5/08

[52] U.S. Cl. ..... 102/202.7; 102/472

[58] Field of Search ..... 89/8, 28.05; 102/202.5, 102/202.7, 430, 472

[56] References Cited

U.S. PATENT DOCUMENTS

| | | | |
|---|---|---|---|
| 803,131 | 10/1905 | Du Pont | 102/202.5 |
| 3,143,069 | 8/1964 | Ostrow | 102/202.7 |
| 3,169,482 | 2/1965 | Noble | 102/202.7 |
| 4,711,154 | 12/1987 | Chryssomallis et al. | 89/7 |
| 4,715,261 | 12/1987 | Goldstein et al. | 89/8 |
| 4,895,062 | 1/1990 | Chryssomallis et al. | 89/7 |
| 4,974,487 | 12/1990 | Goldstein et al. | 89/7 |
| 5,072,647 | 12/1991 | Goldstein et al. | 89/8 |
| 5,235,127 | 8/1993 | Findley | 102/472 |
| 5,261,315 | 11/1993 | Marinos | 102/472 |
| 5,444,208 | 8/1995 | Mortensen | 219/121.48 |

FOREIGN PATENT DOCUMENTS

| | | | |
|---|---|---|---|
| 1013360 | 12/1965 | United Kingdom | 89/28.05 |

OTHER PUBLICATIONS

Popular Science, "Tabletop Artillery", Aug. 1992, p. 26.

*Primary Examiner*—Stephen C. Bentley
*Attorney, Agent, or Firm*—Brooks & Kushman P.C.

[57] ABSTRACT

A plasma generator (44) for an electrothermal gun cartridge has elongated metallic rod and tube members (58,60) extending along a central axis thereof with the tube member (58) having at least one axial gap (62) and with an elongated annular insulator located between and in engagement with both metallic members to provide support therebetween as an electrical voltage generates an electrical arc at the axial gap to provide a plasma that ignites a propellant (46). Different embodiments of the plasma generator have a plurality of the axial gaps (62) located along the tube member (60) and are constructed for both simultaneous and sequential firing with fuses (74) controlling the timing. Helically extending member portions (78) provide rotation of the electrical arc and hence the plasma generated to distribute it for ignition of the propellent (46).

11 Claims, 13 Drawing Sheets

Fig. 20
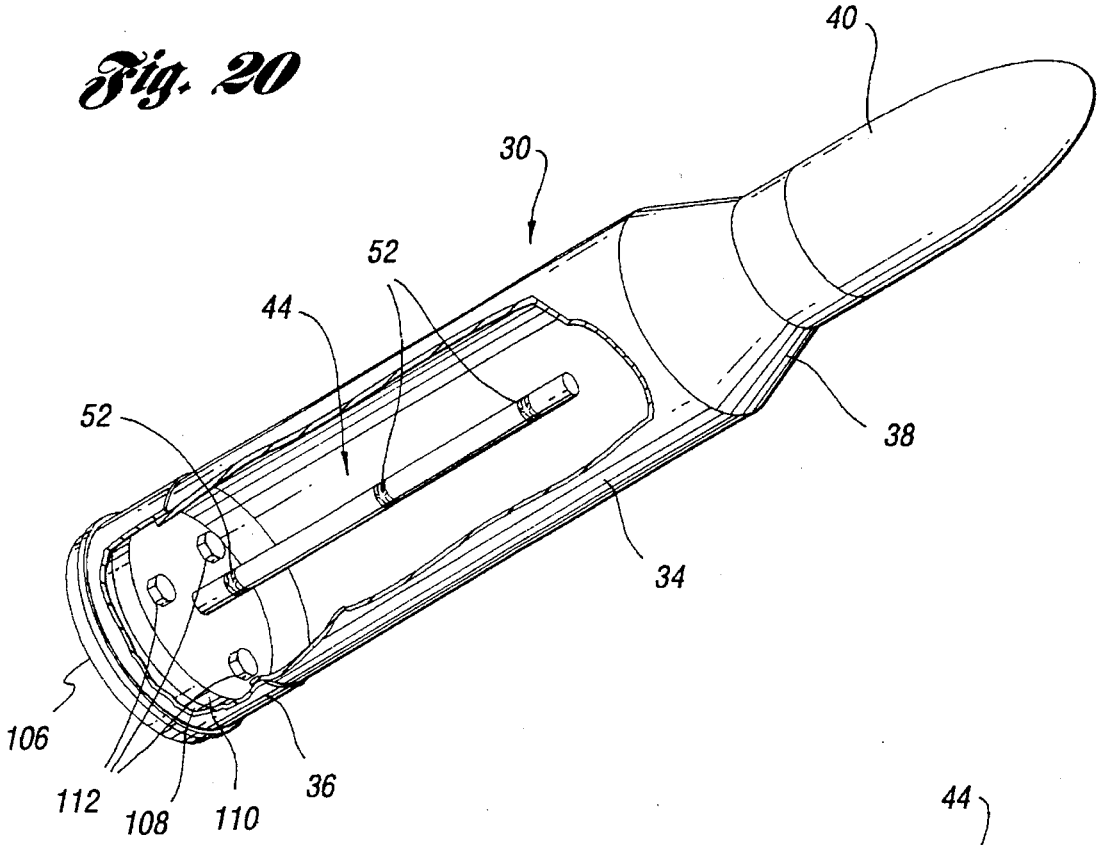
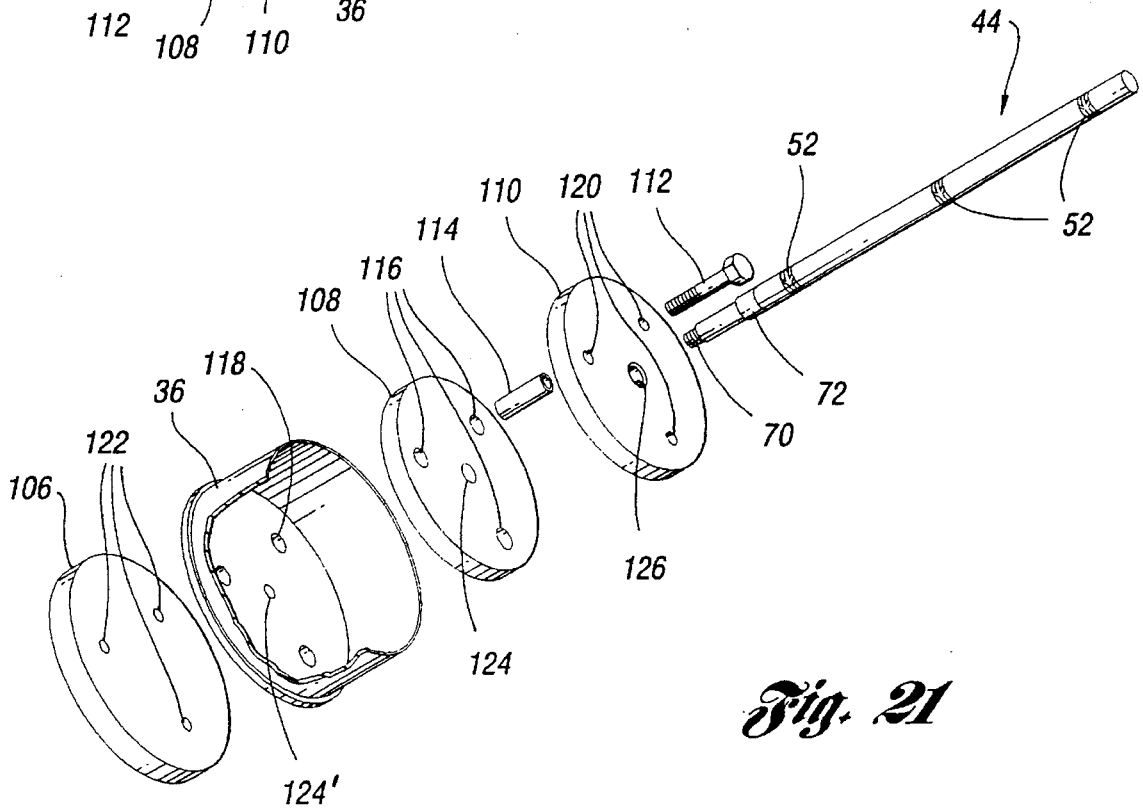
Fig. 21

Fig. 22
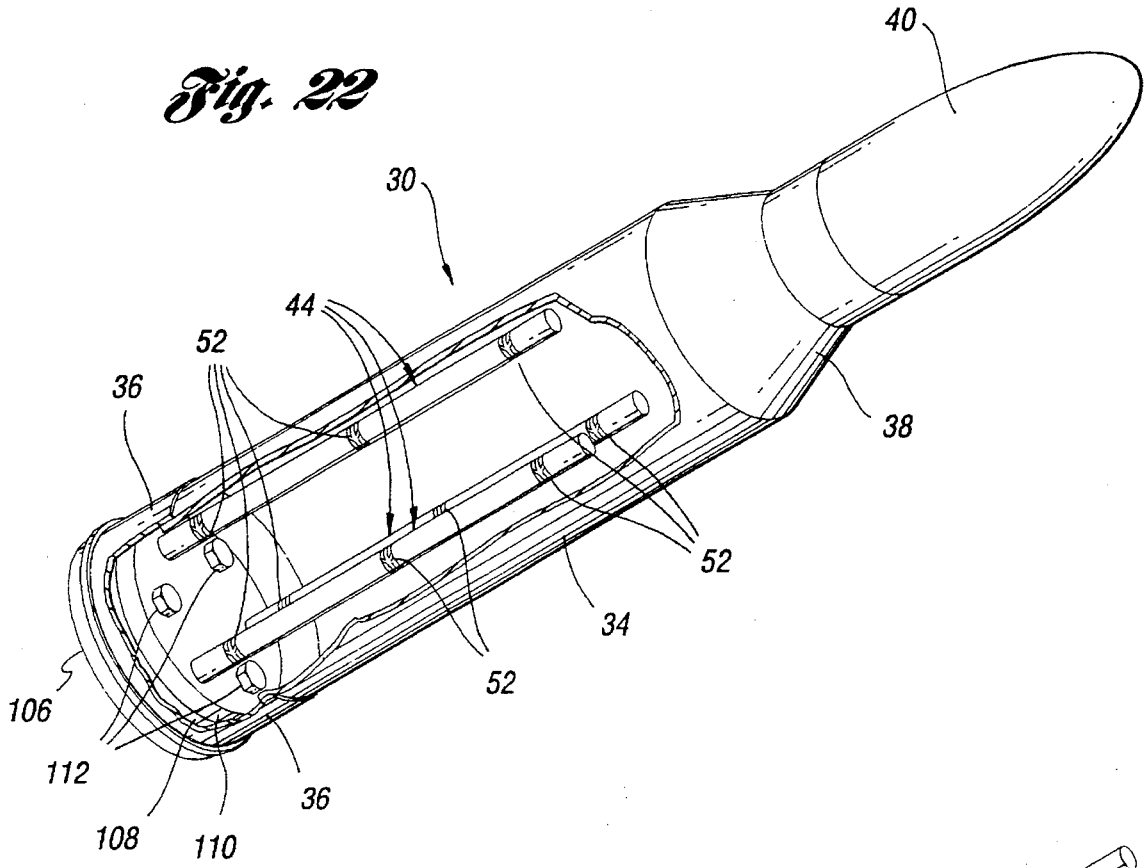
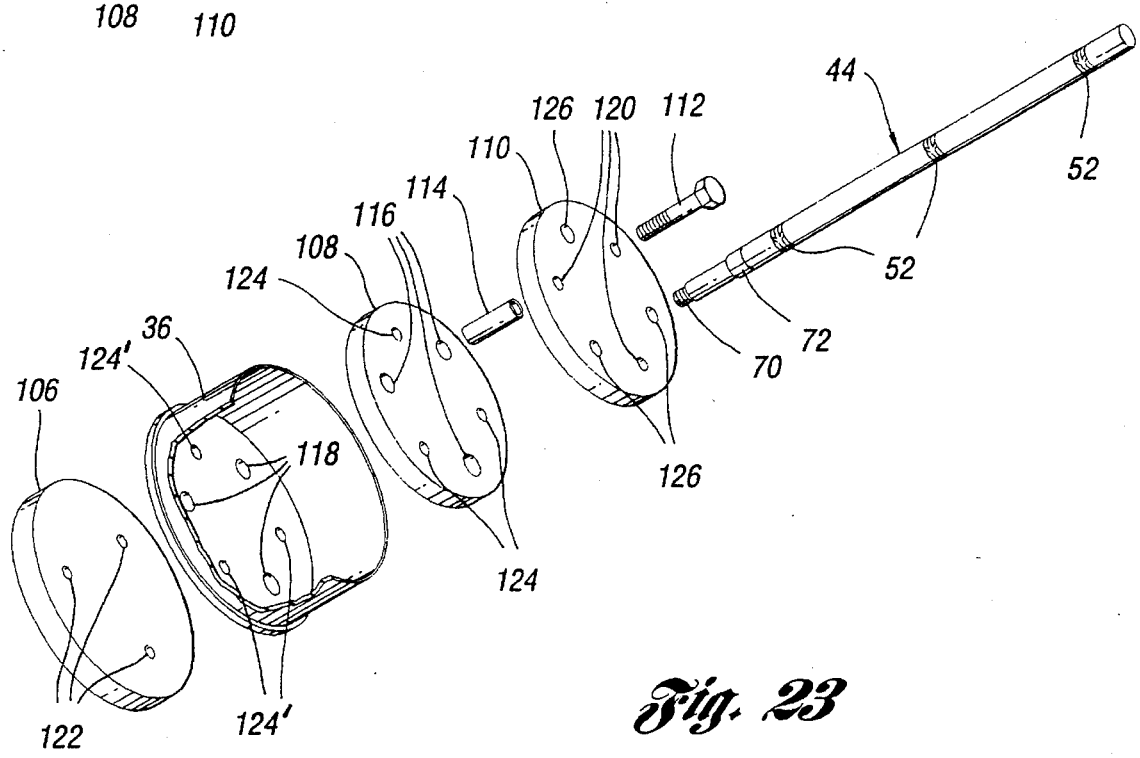
Fig. 23

PLASMA GENERATOR FOR ELECTROTHERMAL GUN CARTRIDGE

TECHNICAL FIELD

This invention relates to a plasma generator for an electrothermal gun cartridge.

BACKGROUND ART

Conventional plasma generators for electrothermal gun cartridges include a pair of axially spaced electrodes between which a capillary extends to generate an electrical arc upon application of an electrical voltage to the electrodes. This electrical arc generates a plasma that ignites a propellant to produce heated and pressurized gas for launching a projectile of the cartridge. Such prior plasma generators are disclosed by U.S. Pat. Nos.: Chryssomallis et al U.S. Pat. No. 4,711,154; Goldstein et al U.S. Pat. No. 4,715,261; Chryssomallis et al U.S. Pat. No. 4,895,062; Goldstein et al U.S. Pat. No. 4,974,487 Goldstein et al U.S. Pat. No. 5,072,647 and Mortensen U.S. Pat. No. 5,444,208.

With such conventional cartridge plasma generators, the electrical arc generated and resultant plasma is not always at the desired location for proper propellant ignition. Furthermore, the relatively large electrical voltage involved of several kilovolts which produces a current on the order of 10 to 100 or so kiloamps produces relatively large electromagnetic and hydrodynamic forces due to the small volumes where plasma is generated. These forces can destroy the cartridge construction and the metallic electrode construction for carrying the current.

DISCLOSURE OF INVENTION

An object of the present invention is to provide an improved plasma generator for an electrothermal gun cartridge so as to precisely control the timing and spacial distribution of plasma to ensure that the propellant ignition proceeds as intended.

In carrying out the above and other objects of the invention, a plasma generator for an electrothermal gun cartridge constructed in accordance with the present invention includes an elongated metallic rod member extending along a central axis of the plasma generator and also includes an elongated metallic tube member that extends around the rod member in a spaced relationship thereto and a coaxial relationship with the rod member. The elongated metallic tube member has at least one axial gap along its length. An elongated annular insulator of synthetic resin is located between and in engagement with both the elongated metallic members such that an electrical voltage applied along the elongated metallic tube member generates an electrical arc at the axial gap thereof to provide a plasma while the insulator and the elongated rod member provide support for the one elongated metallic member.

This construction of the plasma generator permits the location and timing of the plasma generation to be accurately controlled without any movement of the members with respect to each other due to the large electromagnetic and hydrodynamic forces that are produced.

Best results are achieved when the axial gap has a fuse that burns away when the voltage is applied to the elongated metallic tube member to facilitate the generation of the electrical arc and hence the plasma. Although it is possible to generate the arc by application of a sufficient voltage at only an air spacing at the axial gap, the fuse more accurately controls the arc generation.

Different constructions of the plasma generator disclosed have the one elongated metallic member provided with a plurality of the axial gaps for generating separate electrical arcs at axially spaced locations from each other. The elongated metallic tube member may have the axial gaps thereof constructed to provide simultaneous generation of the separate electrical arcs at the axial gaps along its length or may have the axial gaps thereof constructed to provide sequential generation of the separate electrical arcs at the axial gaps along its length. The sequential generation of the separate electrical arcs can be provided by completely insulating the metallic members from each other at the axial gaps such that there is no electrical arcing therebetween as the electrical arcs are established at the axial gaps. With it is also possible for the insulator to have a construction adjacent the axial gaps of the metallic rod member to permit electrical arcing transverse to the central axis of the plasma generator between the elongated metallic members as the electrical arcs are established at the axial gaps.

The plasma generator can also be constructed so that the electrical arc has a rotational movement that uniformly distributes the plasma and hence uniformly initiates the propellant of the associated gun cartridge. The tube member metallic having the axial gap, can be provided with generally helically extending portions of opposite pitch at opposite sides of the axial gap to cause the rotational movement of the electrical arc. There can be a plurality of the axial gaps and associated helical portions that can be operated either simultaneously or sequentially as previously discussed.

It is also possible for the plasma generator to include a second elongated metallic tube member that receives the first mentioned elongated metallic tube member in a spaced relationship thereto and a coaxial relationship therewith as well as with the rod member. A second elongated annular insulator of synthetic resin is located between and in engagement with both elongated metallic tube members. Another one of the elongated metallic members has at least one axial gap for generating an electrical arc to provide a plasma when an electrical voltage is applied along its length. As disclosed, the first and second elongated metallic tube members have the axial gaps and each includes a plurality of the axial gaps.

The objects, features and advantages of the present invention are readily apparent from the detailed description of the best modes for carrying out the invention when taken in connection with the accompanying drawings.

BRIEF DESCRIPTION OF DRAWINGS

FIG. 20 is a partially broken away perspective view of an electrothermalgun cartridge with the plasma generator of this invention mounted within its casing;

FIG. 21 is a disassembled perspective view of the base end of the casing shown in FIG. 20 to illustrate the manner in which the assembly is provided;

FIG. 22 is a partially broken away perspective view of another electrothermal gun cartridge with a plurality of the plasma generators mounted within its casing; and FIG. 23 is an exploded perspective view of the base end of the casing shown in FIG. 22 to illustrate the manner in which the assembly is performed.

BEST MODES FOR CARRYING OUT THE INVENTION

Figure 1A:
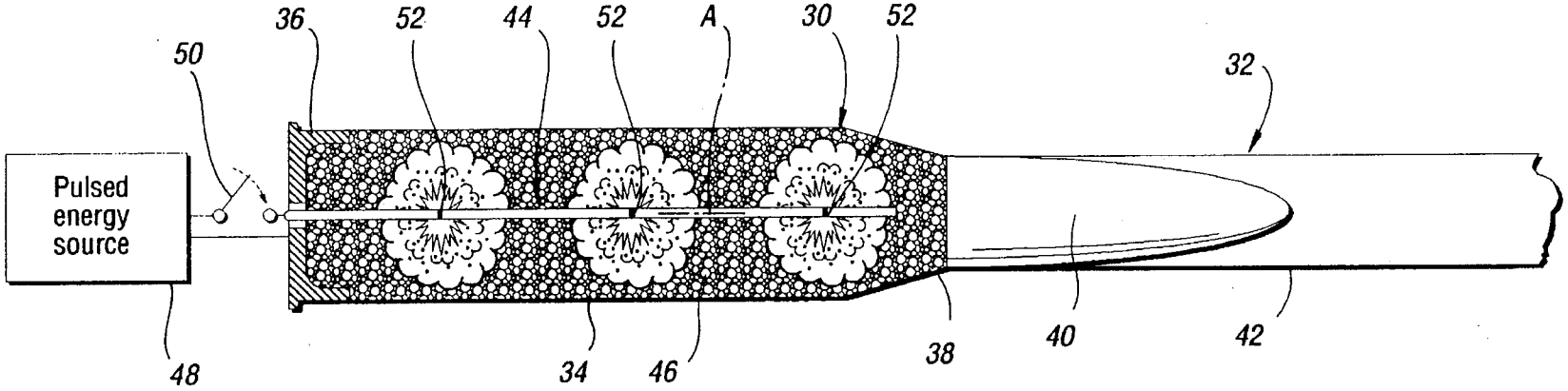
FIG. 1*a* is a schematic view of a gun and an electrothermal gun cartridge which includes a plasma generator that is constructed in accordance with the present invention and has multiple sites for simultaneous plasma generation along its elongated length to ignite a propellant of the cartridge.

With reference to FIG. 1*a*, an electrothermal gun cartridge 30 is illustrated somewhat schematically as being within a gun 32 and as having a casing 34 with a base end 36 and a projectile end 38 the latter of which supports a projectile 40 to be fired through the tube 42 of the gun. Within the cartridge casing 34, the cartridge includes a plasma generator 44 that is constructed in accordance with the present invention to generate a plasma for igniting a propellant 46 that is located within the casing. This plasma generation as is hereinafter more fully described is provided by application of a pulse of electrical energy from a source 48 upon closing of a switch 50. The voltage involved is relatively large such as on the order of several kilovolts and produces a current flow of tens of kiloamps such as on the order of 100 kiloamps. This large current flow produces relatively large electromagnetic forces as well as substantial forces due to electrical arcing that generates the plasma. The construction of the plasma generator as is hereinafter more fully described is capable of withstanding these forces while nevertheless providing the plasma generation at the designed location. The propellant 46 includes a fuel and an oxidizer, such as a slurry of aluminum powder and water, and burns in a time on the order of about one to several milliseconds as opposed to the much faster combustion through shock propagation involved with explosion which takes place in microseconds.

As illustrated in FIG. 1*a*, there are a plurality of sites 52 along the length of the plasma generator where the plasma is generated to ignite the propellant 46. While the construction of the plasma generator 44 has applicability to even a single site of plasma generation, the ability to generate plasma at multiple sites that are precisely located for igniting the propellant advantageously provides effective cartridge operation. Ignition of the propellant by the plasma as shown in FIG. 1*a* generates heated and pressurized gas that is schematically indicated by 54 in FIG. 1*b* and causes expansion in the direction indicated by arrows 56 to launch the projectile 40.

Figure 2A:
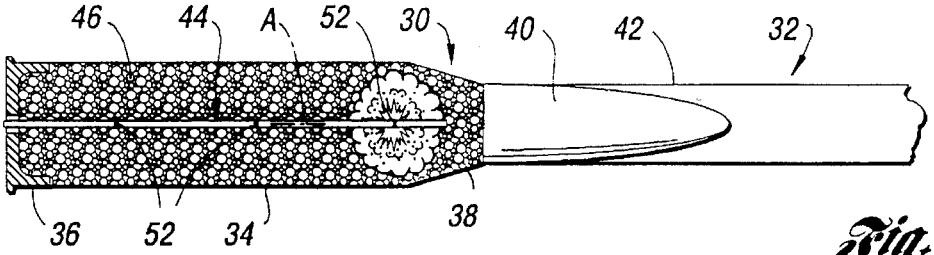
FIGS. 2*a*–2*g* are schematic views of a gun and an electrothermal gun cartridge having a plasma generator according to the invention with multiple sites for sequentially generating a plasma that ignites the propellant of the cartridge to generate heated and pressurized gas that launches the projectile.
Figure 2B:
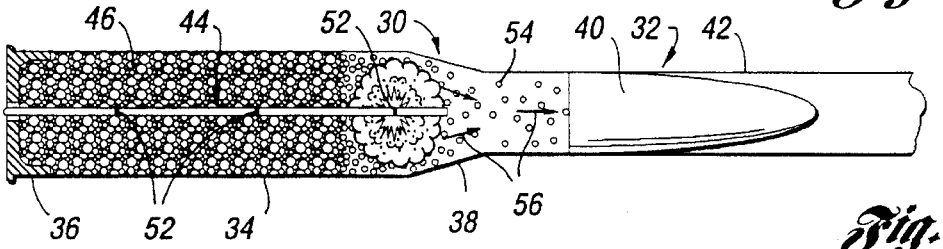
Figure 2C:
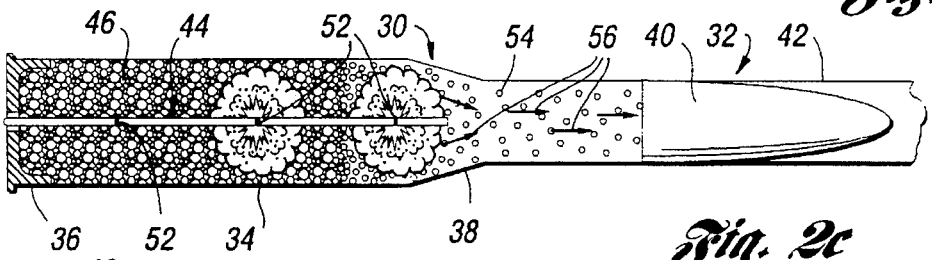
Figure 2D:
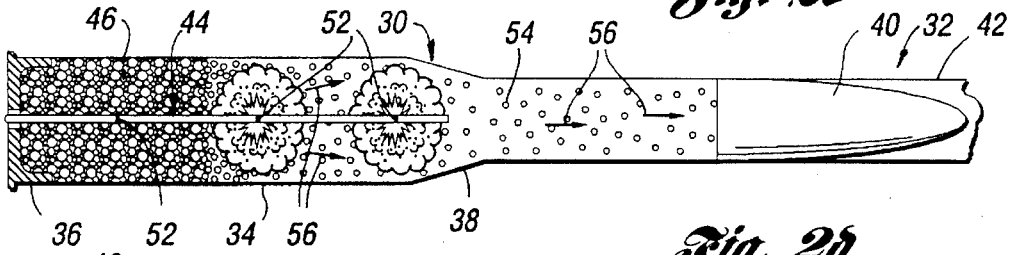
Figure 2E:
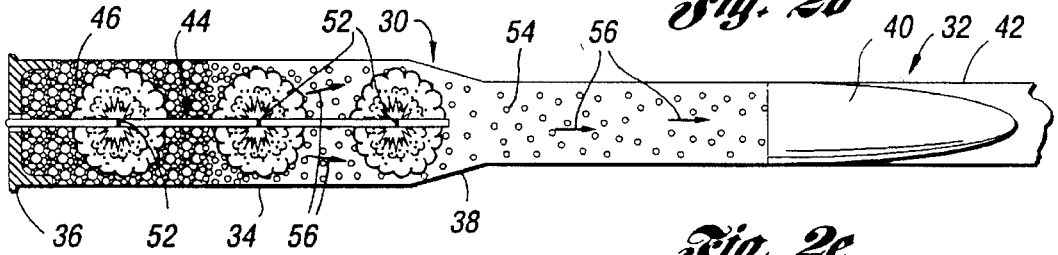
Figure 2F:
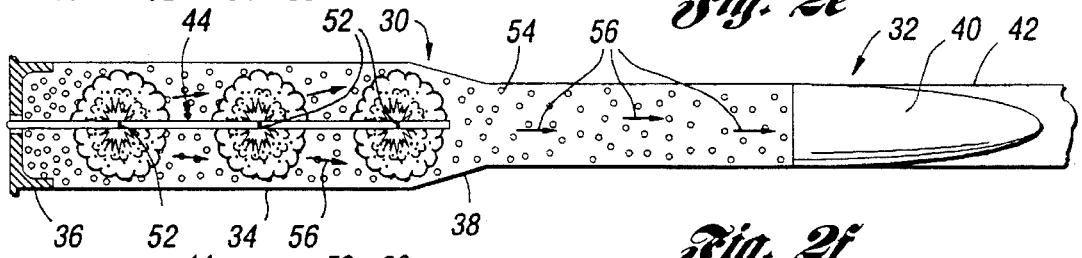
Figure 2G:
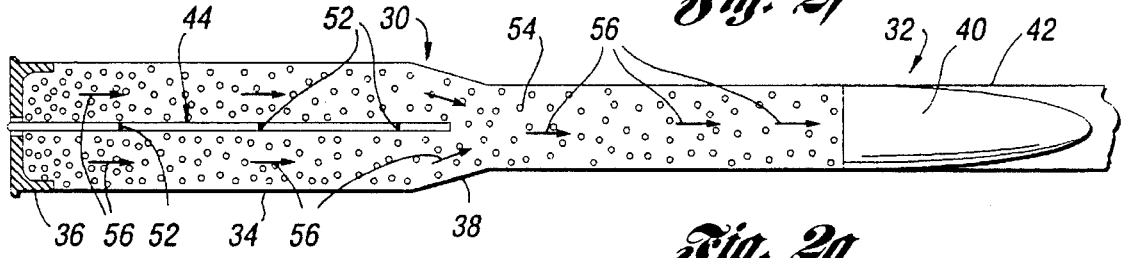
Figure 3:
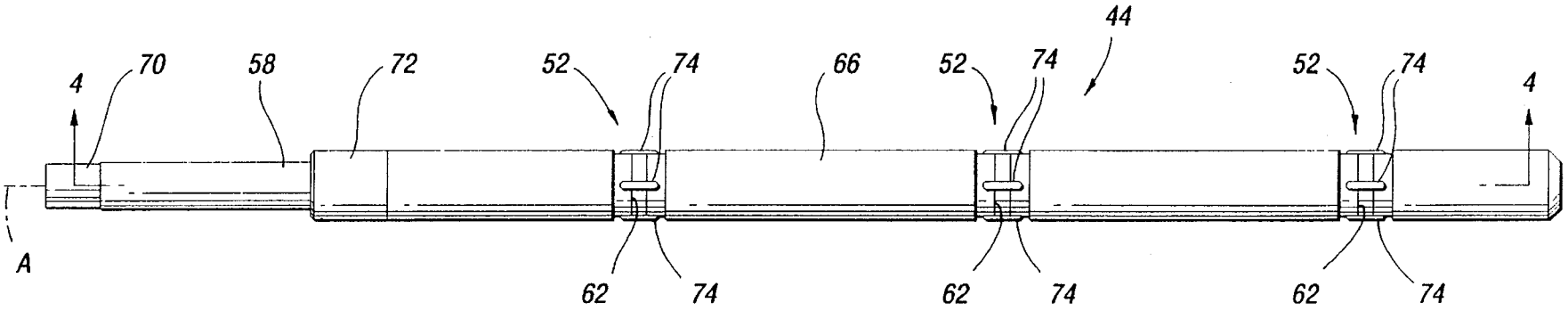
FIG. 3 is a side view of one embodiment of the plasma generator.

As is hereinafter more fully described, it is also possible for the plasma generator 44 to be constructed to provide sequential generation of the plasma at the sites 52 as illustrated in FIGS. 2*a*–2*g*. More specifically, the site 52 immediately adjacent the projectile 40 is first fired as shown in FIG. 2*a* to ignite the adjacent propellant 46 and generate the gas 54 shown in FIG. 2*b* so that the expansion shown by arrows 56 begins the projectile movement. After the initial firing, the next site 52 generates a plasma as shown in FIG. 2*c* to ignite the adjacent propellant 46 and generate additional heated and pressurized gas 56 that continues the expansion shown by arrows 56 and the further movement of the projectile 40. The next site 52 adjacent the base end 36 of the casing is fired as shown in FIG. 2*a* to ignite the adjacent propellant 46 and generate further gas that continues the expansion as shown in FIG. 2*f* after which all of the propellant is ignited and generates heated and pressurized gas for completion of the firing as shown in FIG. 2*g*.

Figure 1B:
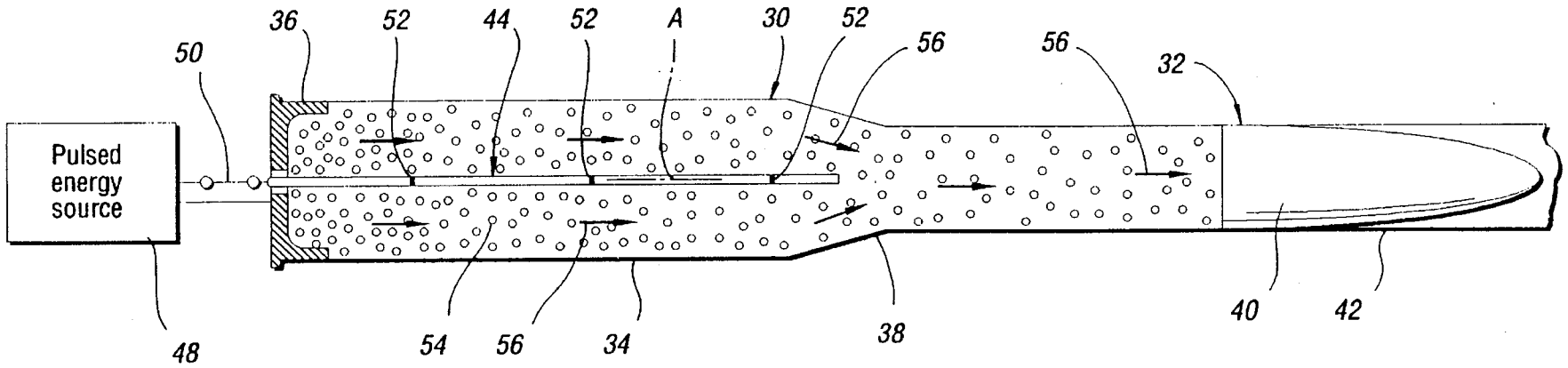
FIG. 1*b* is a schematic view of the gun and cartridge of FIG. 1*a* but at a later stage after the propellant has been ignited to provide a heated and pressurized gas for launching a projectile of the cartridge.

It should be appreciated for both the simultaneous firing illustrated in FIGS. 1*a* and 1*b* and the sequential firing indicated in FIGS. 2*a*–2*g* that two or more than the three sites 52 of plasma generation can be utilized depending upon the particular cartridge involved.

With reference to FIGS. 3–6, one embodiment of the plasma generator 44 for the electrothermal gun cartridge previously described includes an elongated metallic rod member 58 extending along the central axis A of the plasma generator. An elongated metallic tube member 60 of the plasma generator extends around the rod member 58 in a spaced relationship thereto and a coaxially relationship with the rod member. The tube member 60 has an axial gap 62 at each site 52 of electrical arcing that generates the plasma. An elongated annular insulator 64 of synthetic resin is located between and in engagement with both elongated metallic members 58 and 60 such that an electrical voltage applied along the one metallic member 60 generates an electrical arc at the axial gap 62 thereof to provide the plasma while the insulator 64 and other metallic member 58 provide support for the elongated metallic member 60.

Figure 4:
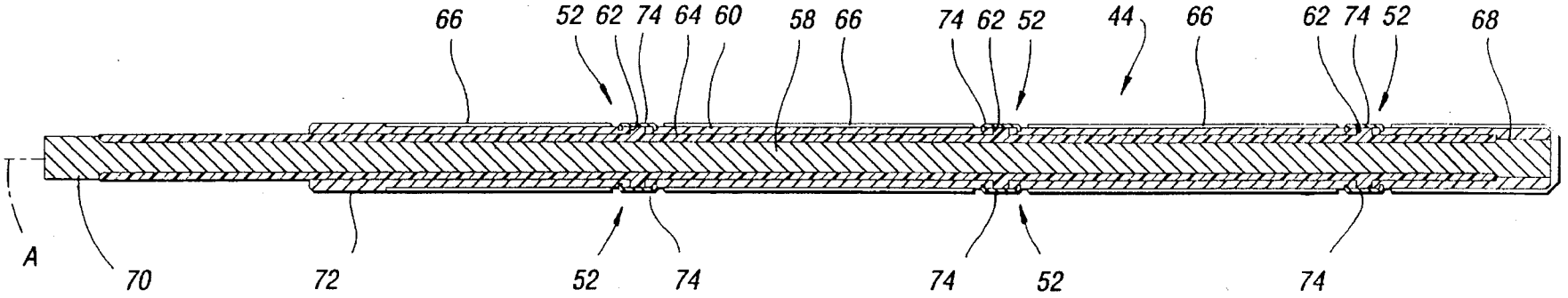
FIG. 4 is a sectional view of the plasma generator taken along the direction of line 4—4 in FIG. 3.

In the preferred construction illustrated, the tube member 60 has an insulative covering 66 extending over its surface except at the arc sites 52 and may be provided by a suitable dielectric adhesive tape that covers the plasma generator 44 generally between its opposite ends. At its right end as shown in FIG. 4, the rod member 58 and tube member 60 have an electrical connection 68 such as by threading to each other. At its left end, the plasma generator 44 is provided with an electrical rod member connection 70 and an electrical tube member connection 72. Electrical flow through the plasma generator is thus along the rod member 58 as well as along the tube member 60 which has the axial gaps 52 where the electrical arc is generated at the arc sites 52. While this is the preferred construction, it should be appreciated that the path of electrical flow along the metallic member which has the axial gaps for generating the electrical arcs can also be completed without electrical flow along the other metallic member such as through the cartridge casing when it is of a metallic construction or through another internal conductor within the casing. Furthermore, both the rod member 58 and the tube member 60 are preferably constructed from a high strength copper alloy such as of and aluminum oxide as available under the trademark GlidCop from SCM Metal Products, Inc. of Research Triangle Park, N.C., U.S.A.

Additionally, the insulator 64 is preferably made by injection molding thereof in situ between the rod and tube members 58 and 60 while also providing the additional insulator material at the arc sites 52 as shown. Such molding is best performed by roughening the outer surface of the rod member 58 and the inner surface of the tube member 60 to enhance the support provided by the insulator 64 between the rod and tube members. This is the preferred construction for manufacturing the insulator 64 even though other possibilities exist such as, for example, the use of tubular plastic sleeves that are inserted between the rod and tube member and then preferably bonded thereto as well as having suitable injection of additional plastic at the arc sites 52 as is hereinafter more fully apparent. It should also be noted that the preferred material for manufacturing the insulator 64 is a thermoplastic alloy of high strength such as an alloy of polybutylene therephthalate and polycarbonate as available from the General Electric Company of Pittsfield, Mass., U.S.A. under its trademark XENOY with its product designation 5220 resin.

Figure 5:
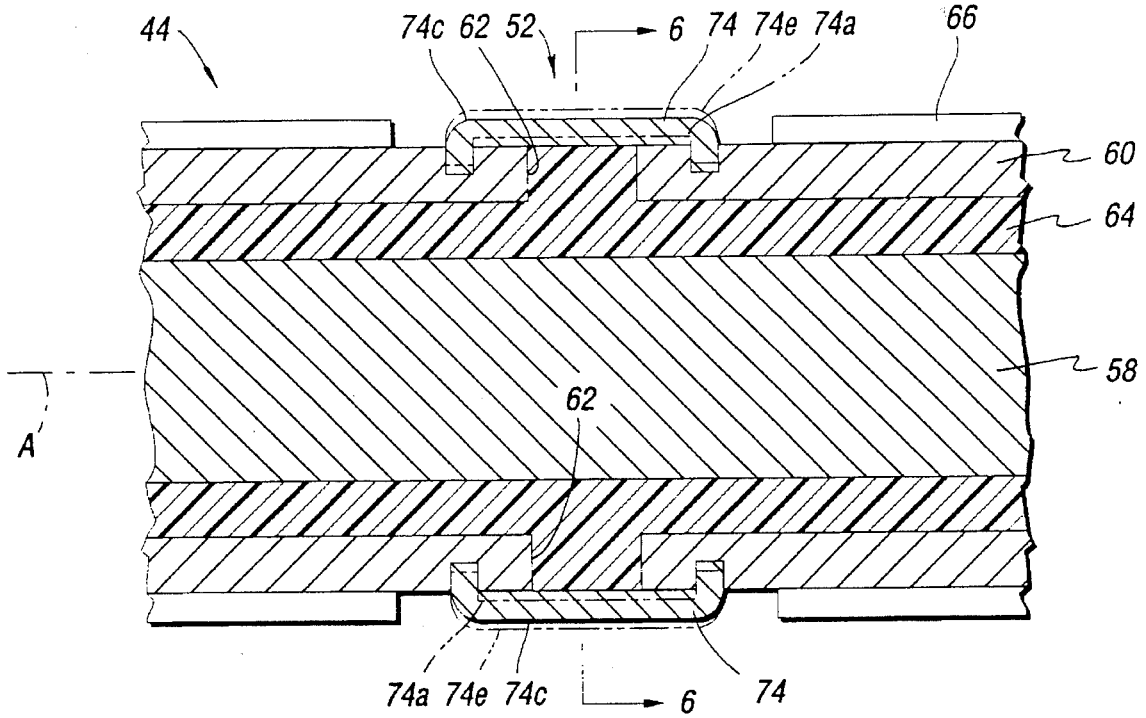
FIG. 5 is an enlarged sectional view of a portion of FIG. 4 to illustrate the construction of the plasma generator and illustrates wire fuses thereof which can have the same size for the simultaneous operation or different sizes as shown by phantom line representation for the sequential operation.
Figure 6:
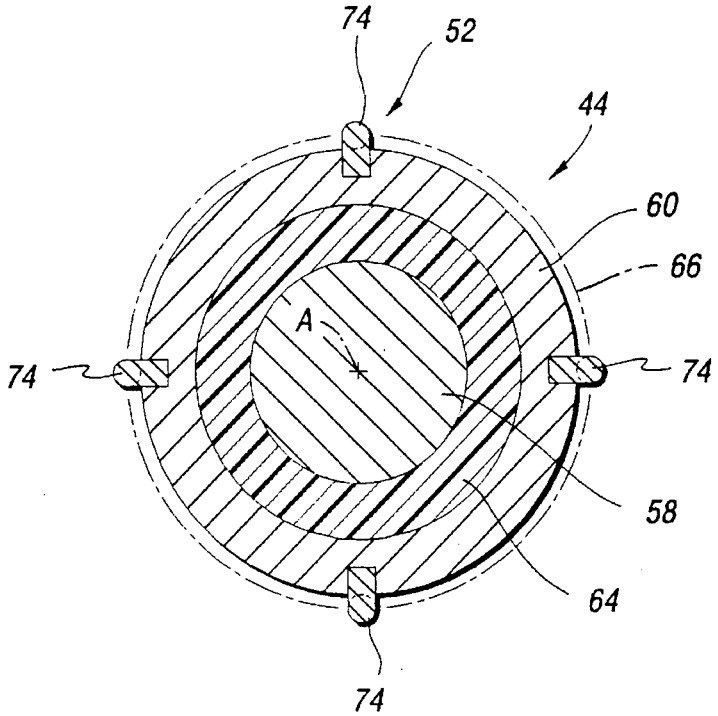
FIG. 6 is a cross-sectional view through the plasma generator taken along the direction of line 6—6 in FIG. 5.

With continuing reference to FIGS. 3–6, the plasma generator 44 has the axial gap 62 provided with a fuse 74 which, as disclosed are wires having opposite ends secured to the tube member 60 to provide electrical connection thereto as best illustrated in FIGS. 5 and 6. These wire type fuses 74 need only be relatively small in diameter, on the order of about one hundredth of an inch or so, to establish the electrical flow that upon burning away of the fuse initiates the arc to generate the plasma as previously described. While the arc generation can be established in some cases by an air gap, it is preferable to utilize a fuse to ensure consistency in timing and in the generation of the arc that produces the plasma. As illustrated, there are fuses 74 spaced circumferentially about the plasma generator 44 as shown in FIG. 6 at four locations to ensure good distribution of the electrical arc and generation of the plasma for igniting the propellant. When the arc initiation is to be simultaneous at all of the sites 52 as previously described in connection with FIGS. 1*a* and 1*b*, the fuses 74 at each site will have the same size as each other so as to burn away at the same time. Furthermore, when the arc initiation is to be sequential as previously described in connection with FIGS. 2*a*–2*g*, the fuses 74 will have a progressively increasing size from the projectile end of the plasma generator toward the base end thereof so that the arc initiation proceeds as previously described. More specific with reference to FIG. 5, the initial arc initiation as previously described in connection with FIG. 2*a* will take place when the phantom line indicated smaller fuse 74*a* first burns away. Thereafter, the next larger solid line indicated fuse 74*c* will fire as previously described in connection with FIG. 2*c*. Subsequently, the phantom line indicated largest fuse 74*e* will fire as previously described in connection with FIG. 2*e*.

Figure 7:
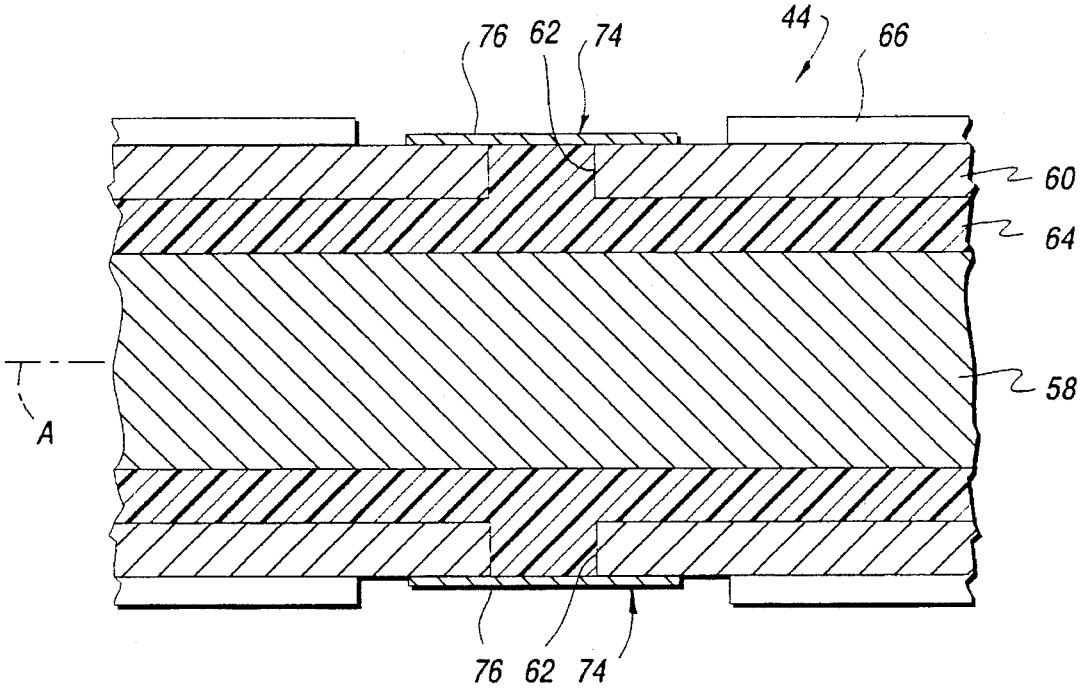
FIG. 7 is a view similar to FIG. 5 of another embodiment wherein the fuses are provided by a carbon coating that can be applied such as by spraying.

With reference to FIG. 7, it is also possible for the fuse 74 to be provided by a coating 76 of an electrically conductive material such as carbon that can be sprayed to extend between the portions of the tube member adjacent the axial gap 62. Such a construction of the fuse by this coating does not as readily lend itself to the sequentially operation previously described in connection with FIGS. 2*a*–2*g* as compared to the wire fuse construction since it is not as easy to control the cross-sectional area of the fuse as is the case when the wires of a predetermined diameter are utilized. Nevertheless, the coating construction does readily lend itself to easy provision of the fuse for use in the simultaneous initiation of the electrical arc and the resultant plasma and through suitable control may, in fact, be utilized to provide the sequential arc initiation.

Figure 8:
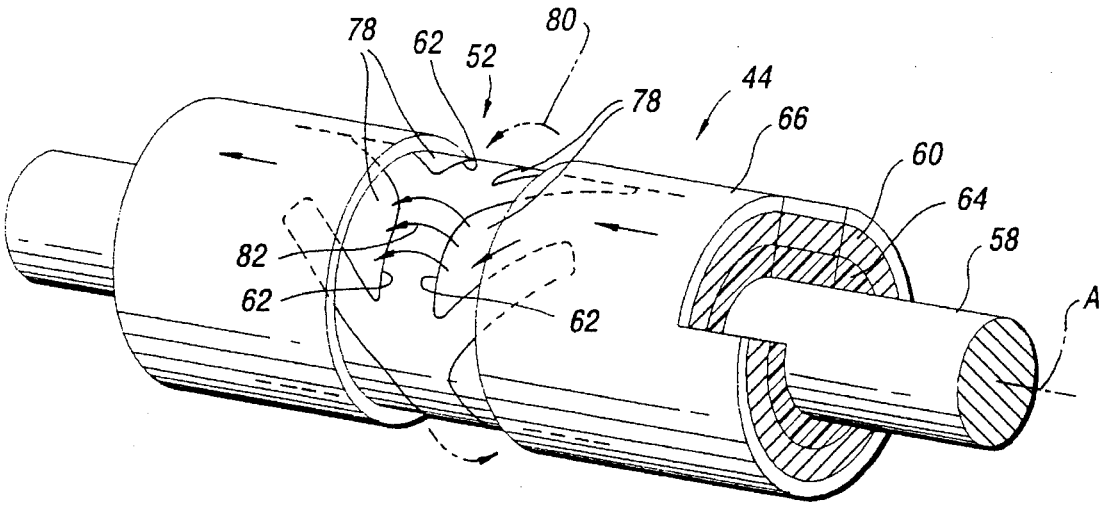
FIG. 8 is a partial perspective view of another embodiment of the plasma generator which has an elongated metallic tube member having helically extending portions in a manner that provides a rotational movement to the electrical arc that is established so as to distribute the plasma generated.

With reference to FIG. 8, another modification of the plasma generator has the tube member 60 provided with generally helically extending portions 78 of opposite pitch at opposite sides of the axial gap 62. The electrical current flowing along these helically extending portions 78 has an azimuthal component about the central axis A and thereby produces a radial magnetic field with respect to the central axis A, which due to the opposite pitches on opposite sides of the axial gap 62 are additive rather than cancelling each other out. The axially flowing current across the axial gap 62 through the radial magnetic field is subjected to an azimuthal force as shown by arrow 80 to provide a rotation to the electrical arc as schematically indicated by 82. Such rotation of the electrical arc distributes the plasma as generated to thereby provide uniform distribution of the igniting of the propellant.

Figure 9:
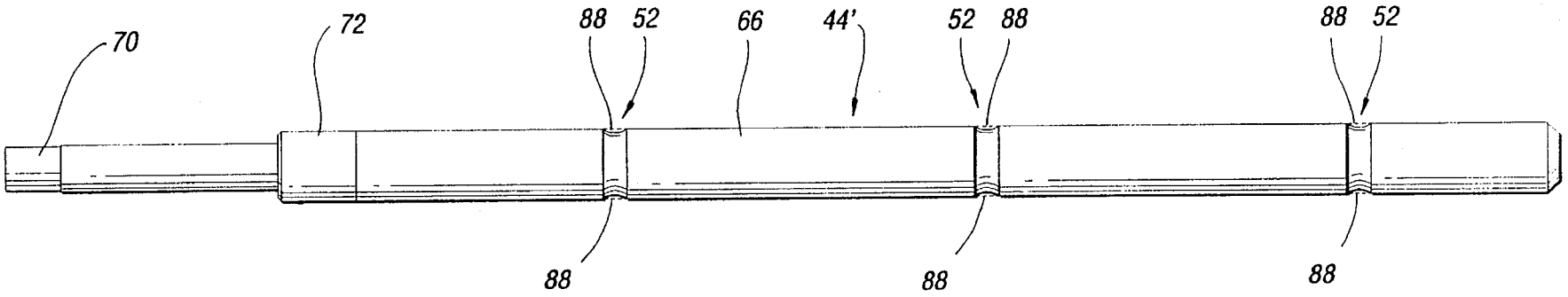
FIG. 9 is a side view of another embodiment of a plasma generator.
Figure 10:
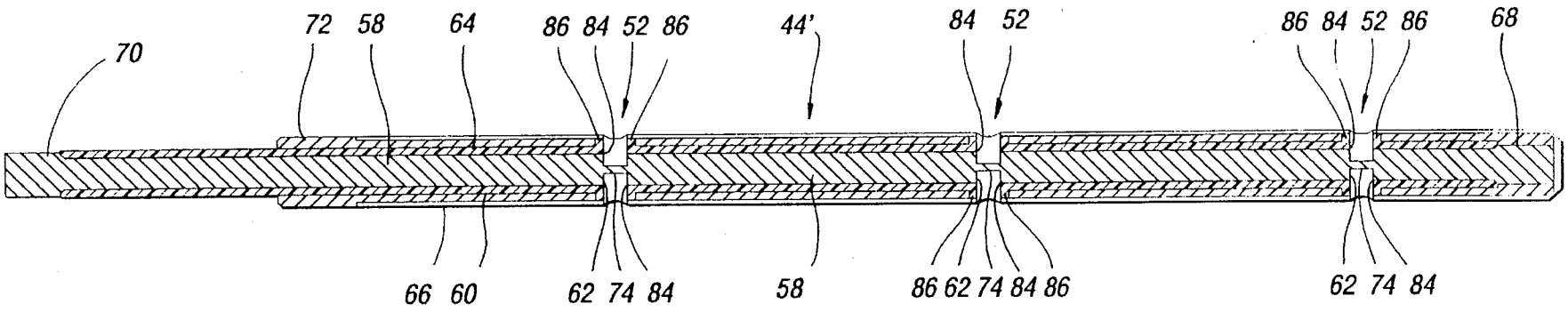
FIG. 10 is a sectional view taken in the same direction as FIG. 9 through the plasma generator to illustrate its construction.
Figure 11:
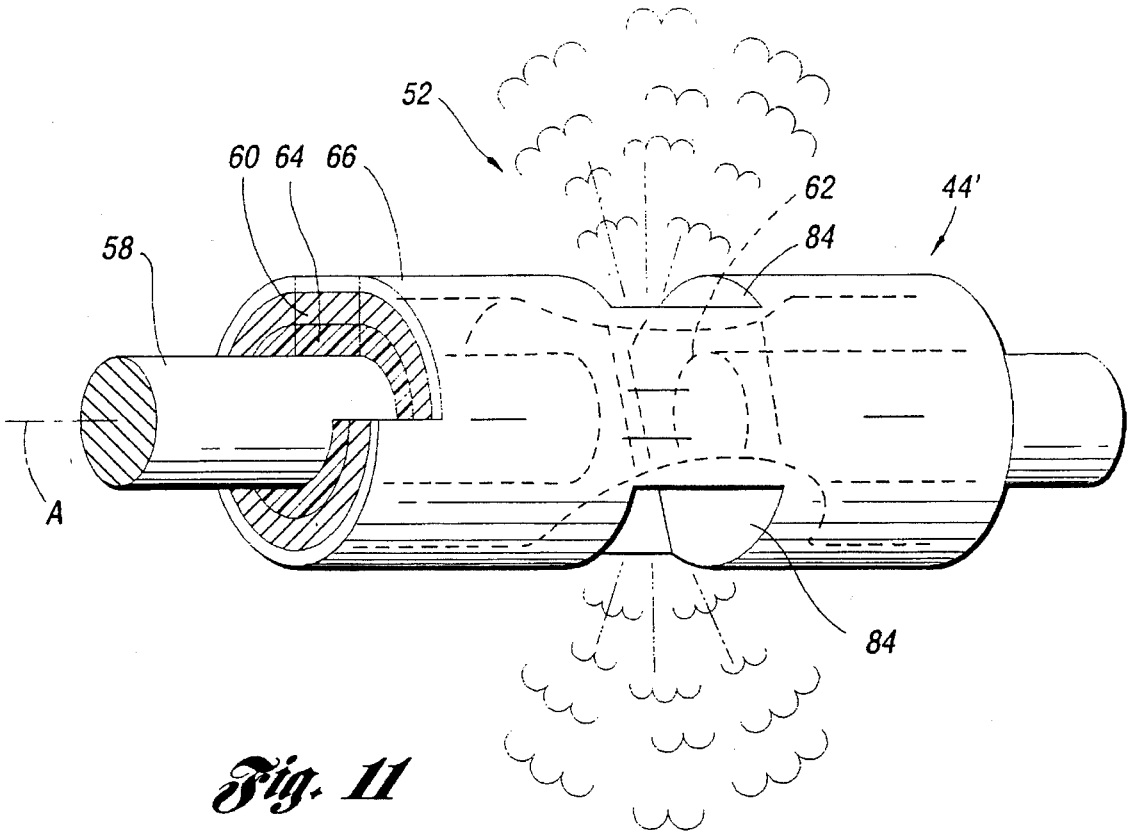
FIG. 11 is a partial perspective view that illustrates the plasma generation of the embodiment of FIGS. 9 and 10.

With reference to FIGS. 9 and 10, another embodiment of the plasma generator 44' has a related but different construction to the previously described embodiment such that some of the previous description is applicable and thus will not be repeated. However, in this embodiment, the rod member 58 is the one elongated metallic member having the axial gap 62 at which the electrical arc is generated as opposed to the tube member 60 as with the previously described embodiment. Thus, current flowing along the rod member 58 generates the electrical arc at each axial gap 62 of the associated site 52 as opposed to the current flowing along the tube member. This embodiment like the previously described embodiment preferably has a fuse 74 at each of its sites 52 so as to ensure precisely controlled timing of the arc initiation. As previously described, these fuses 74 may have the same cross-sectional area as each other to provide simultaneous initiation of the electrical arc or may have a progressively increasing cross-sectional area from the right toward the left to provide the sequential initiation of the electrical arc as also previously described. One way in which to control the size of the fuses 74 is to provide drilled holes 84 from opposite sides while leaving the central portion of the rod member 58 to provide the fuse 74. For the simultaneous initiation of the electrical arc, the holes 84 will thus all terminate at the same depth to leave the same amount of material for each fuse 74; whereas for the sequential operation the holes 84 will be progressively shallower from the right toward the left to leave a greater cross-sectional area. Provision of the holes 84 also provides openings through both the elongated metallic tube member 60 and the elongated annular insulator 64 through which the plasma generated by the electrical arc can flow outwardly as depicted in FIG. 11 wherein the holes 84 are somewhat modified and shown as being bored square rather than round which is the case in FIG. 10.

Figure 12:
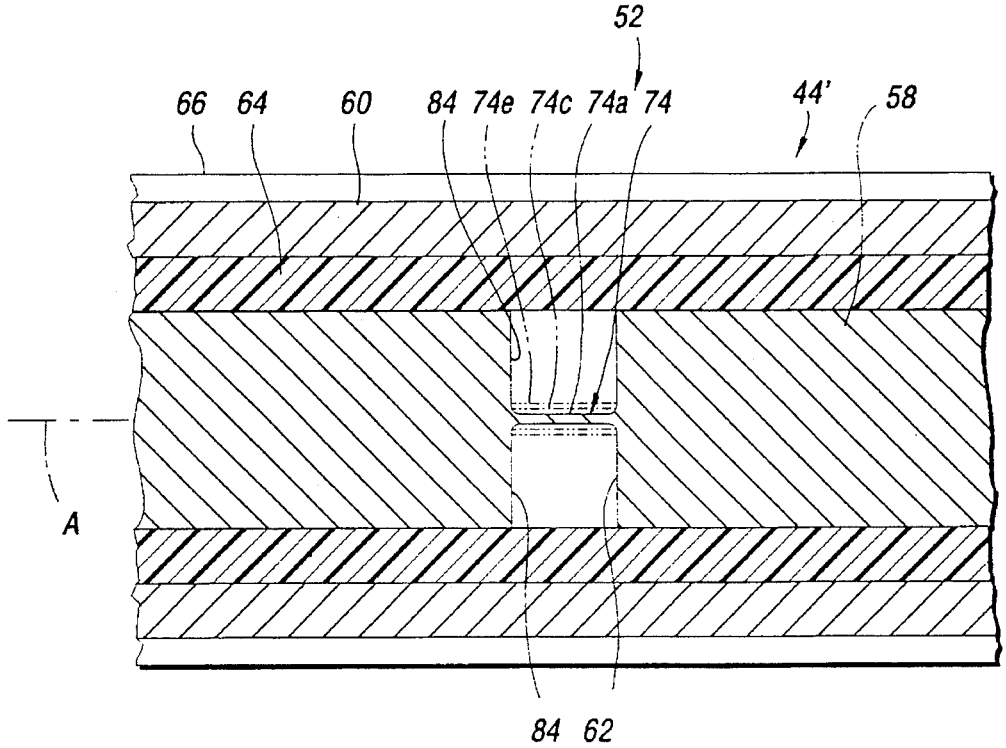
FIG. 12 is an enlarged sectional view of a portion of FIG. 10 to further illustrate the construction of the plasma generator at a fuse location which can have the same size fuses as shown by solid line representation for the simultaneous operation or different size fuses as shown by phantom line representation for the sequential operation.

With reference to FIG. 12, the plasma generator 44' is illustrated viewed along the direction of holes 84 and has the same construction previously described except that the fuse 74 is also shown as having different sizes 74*a*, 74*c* and 74*e* for providing sequentially fuse burning and arc initiation, and the fuse is also shown as having its web shape extending parallel to the direction of the holes 84 rather than across the direction of the holes.

Figure 13:
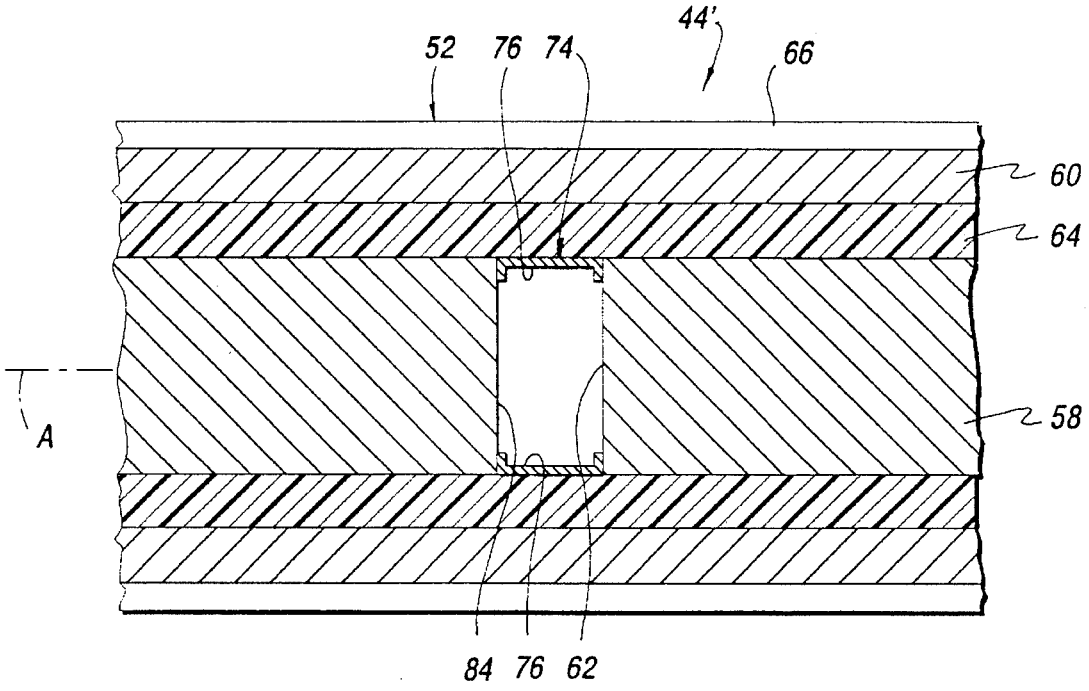
FIG. 13 is a view similar to FIG. 12 of another embodiment of the plasma generator wherein the fuse is provided by a coating of carbon.
Figure 14:
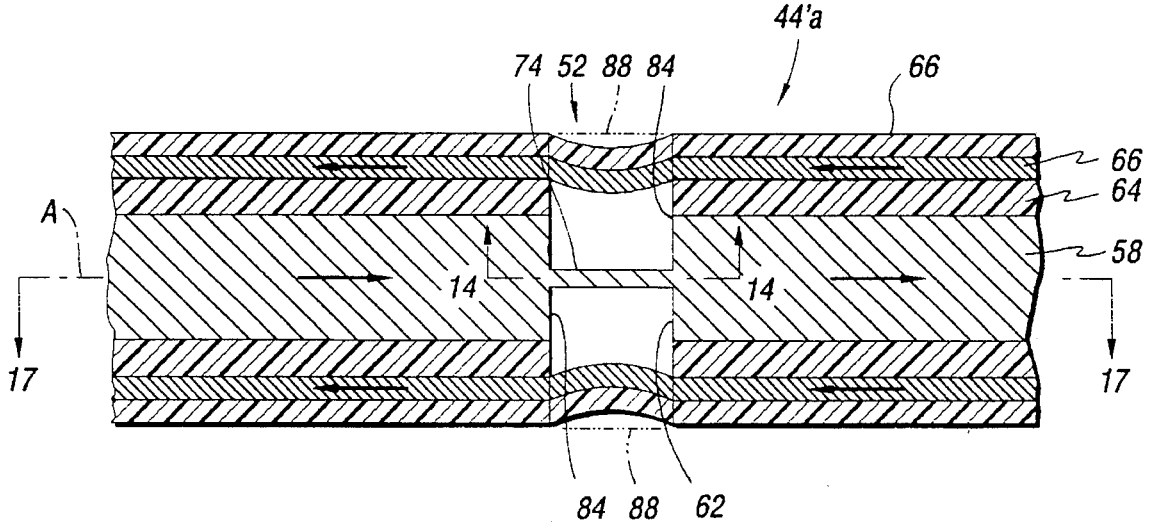
FIGS. 14, 15 and 16 are sequential views similar to FIG. 12 of another embodiment that provides shunting of the electrical arc between an elongated metal rod member and an elongated metal tube member in addition to axial arcing after the fuse burns away.
Figure 15:
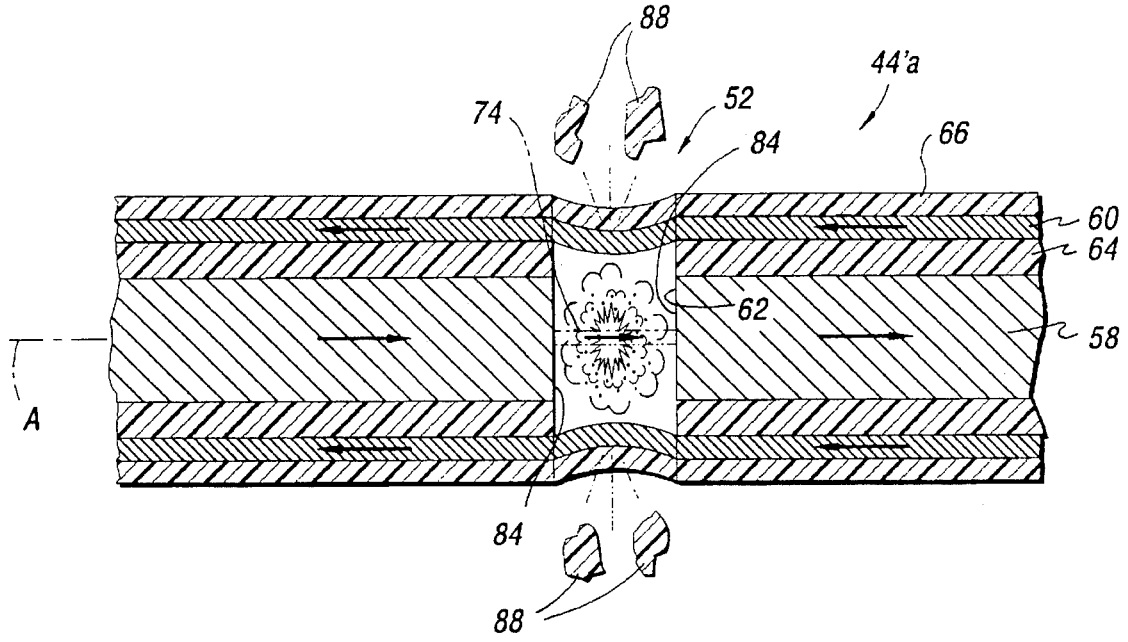

With reference to FIG. 13, the plasma generator 44' is illustrated view along the direction of the hole 84 and having the same construction as generally previously described in connection with FIGS. 9–12 except that its fuse 74 is provided by an electrically conductive coating 76 such as of carbon as previously described in connection with the embodiment of FIG. 7. This electrically conductive carbon coating 76 extends between the portions of the rod member 58 at its axial gap 62 to provide the fuse 74 that burns away as the electrical voltage is applied to generate the arc that provides the plasma.

Each of the embodiments of FIGS. 9–13 as best illustrated in FIG. 10 has its insulator 64 completely insulating the rod and tube members 58 and 60 from each other which, adjacent the sites 52 is provided by annular insulator portions 86 so that there can be no electrical arcing in a radial direction with respect to the axis A. Also, it is best to fill the holes 84 with a suitable filler 88 (FIG. 9) such as a foam or another plastic that blows away when the electrical arc is established to generate the plasma.

Figure 16:
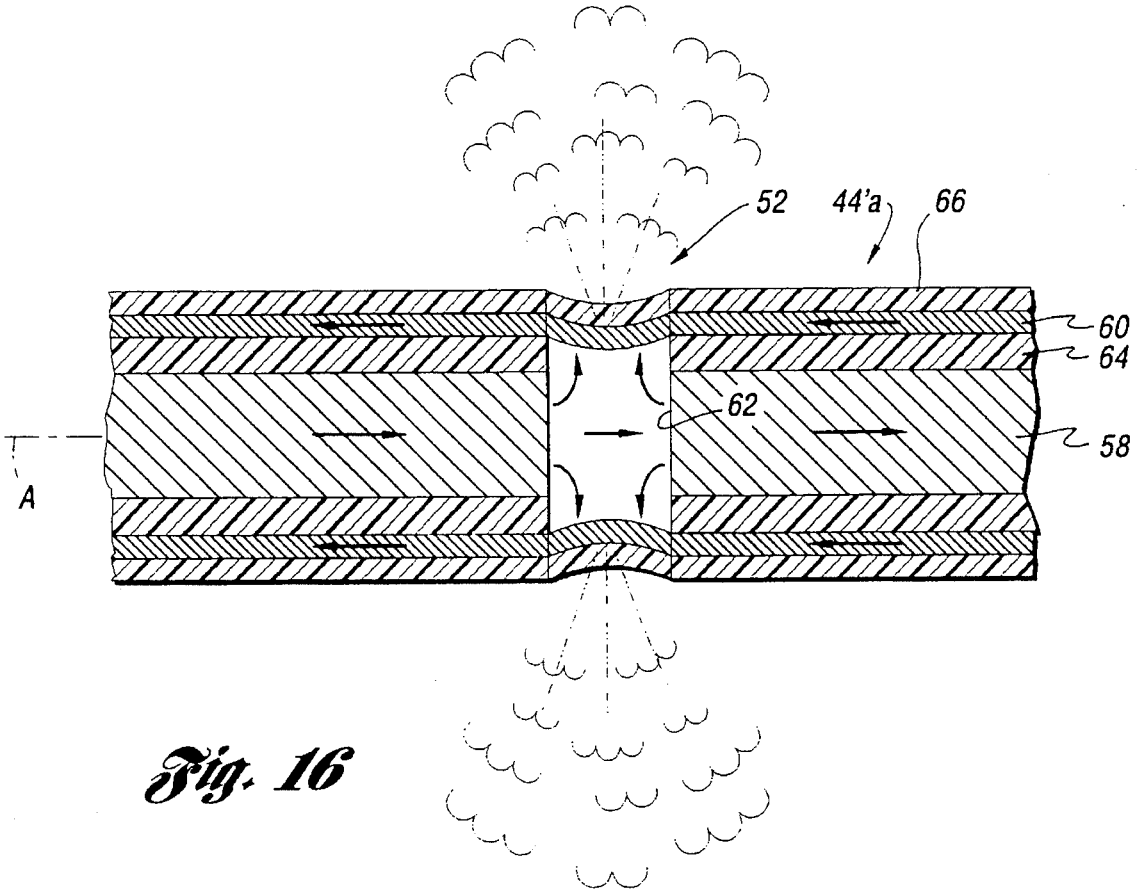
Figure 17:
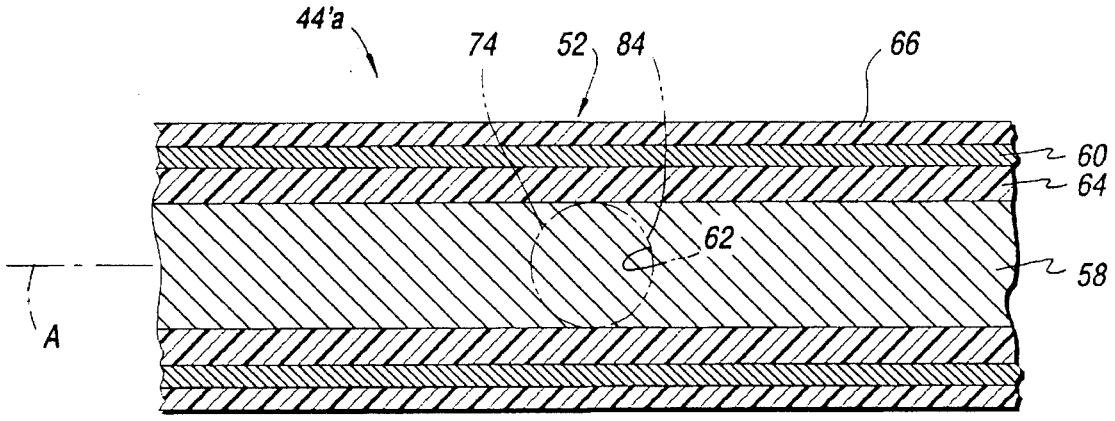
FIG. 17 is a sectional view taken along the direction of line 17—17 in FIG. 14 to illustrate the manner in which the fuse can be made by drilling of round holes from opposite sides of the plasma generator.

With reference to FIGS. 14–17, another embodiment of the plasma generator 44'a has generally the same construction as described in connection with FIGS. 9–13 except as will be noted. In this embodiment, the current must flow along both the rod member 58 and the tube member 60 but the construction does not completely isolate these members electrically from each other after the filler 88 blows away as the fuse 74 bursts. The electrical current flow then as shown in FIG. 16 also flows between the rod member 58 and the tube member 60 to provide a shunting in addition to a small amount of continual axial current flow along the entire length of the plasma generator through both the rod member and the tube member due to the axial arcing. In other words, there will then be both axial and radial arcing for generation of the plasma. The radial arcing is thus transverse to the central axis A of the plasma generator between the elongated metallic rod and tube members 58 and 60 as the electrical arc is established at the axial gap 62 of the rod member.

Figure 18:
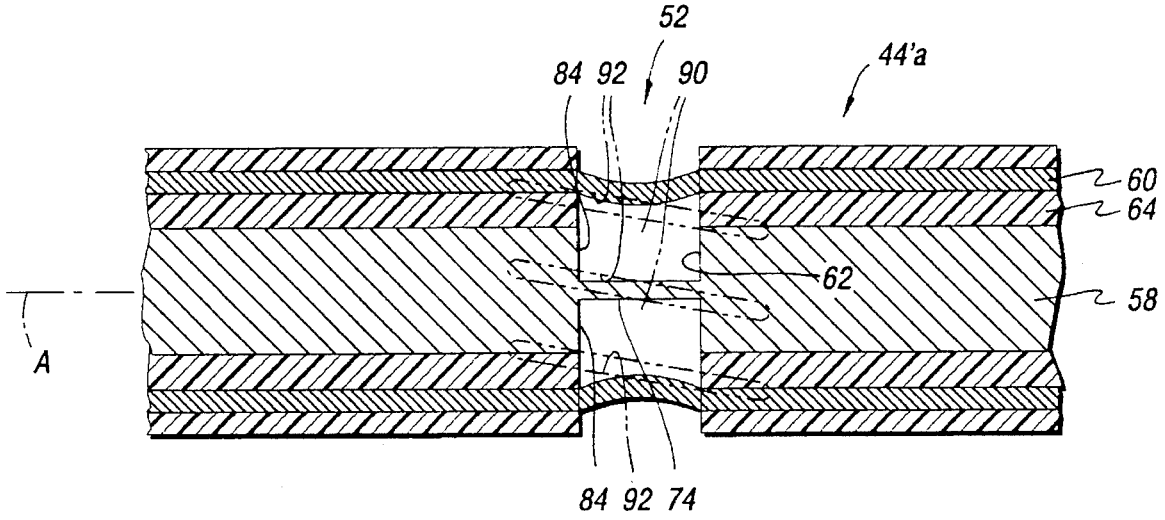
FIG. 18 is a view similar to FIG. 14 but illustrating by phantom line representation helically extending portions of the elongated metallic tube member to provide rotation of the arc for distribution of the plasma.

As illustrated in FIG. 18, the plasma generator 44'*a* may also have its electrical arc site 52 constructed with the elongated metallic tube member 60 having helically extending portions 90 provided by helically extending slots 92 to provide the electrical current flowing along the helical portions with an azimuthal component that provides an axially extending magnetic field. The radial current flowing between the rod and tube members 58 and 60 through the axially extending magnetic field is subjected to an azimuthal force about axis A such that the electrical arc rotates and thereby distributes the plasma generated. With this construction, it is also necessary for the slots 92 to extend through the insulator 64 so that the arc and plasma generated can exit the plasma generator.

Figure 19:
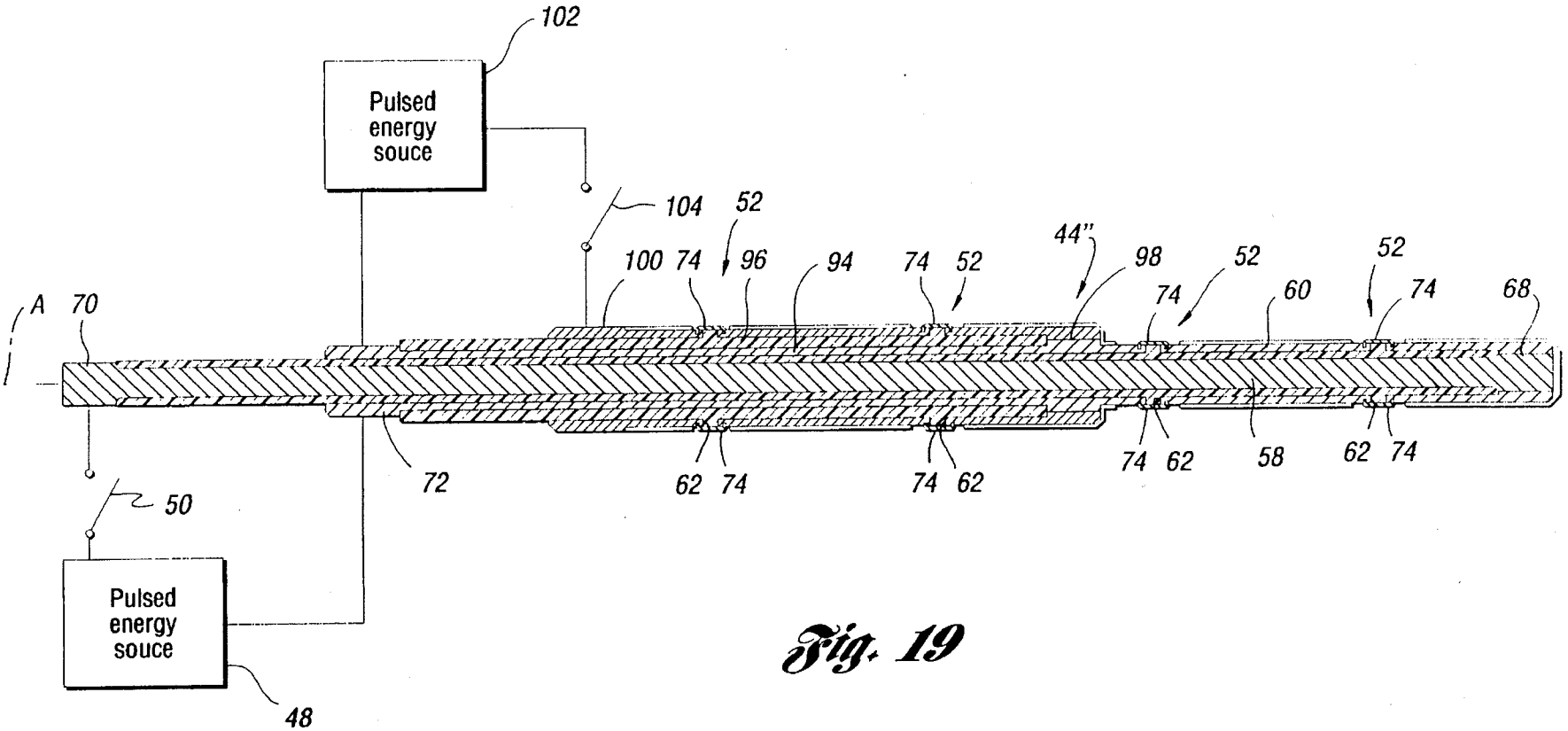
FIG. 19 is a sectional view of a further embodiment which includes first and second elongated metallic tube members that are coaxial with each other and with an elongated metallic rod member and utilized in association with two voltage supplies.

As illustrated in FIG. 19, another embodiment of the plasma generator 44" has the same construction as the embodiment of FIGS. 3–6 but also has a second elongated metallic tube member 94 that receives the first tube member 60 in a spaced relationship thereto and a coaxial relationship therewith. A second elongated annular insulator 96 of synthetic resin is located between and engagement with both elongated metallic tube members 60 and 94 in the same manner previously described in connection with the first insulator 64. The second elongated metallic tube member 94 has a pair of sites 52 where axial gaps 62 of the second tube member 94 are located with associated fuses 74 for use in arc initiation in the same manner previously described. In this embodiment, there are two of the fuse sites 52 along the first tube member 60 and there are also two of the fuse sites 52 along the second tube member 94. In addition to the electrical connection 68 between the rod member 58 and the first tube member 60, there is also an electrical connection 98 between the first tube member 60 intermediate its ends and the right end of the second tube member 94. Furthermore, the left end of the second tube member 94 has another electrical connection 100. The source of electrical voltage 48 as with the previously described embodiment is connected between the electrical connection 70 and the electrical connection 72 to generate the electrical arcs and the plasma at the two sites 52 associated with the rod member 58 and the first tube member 60, while another source of electrical voltage 102 having an associated switch 104 extends between the electrical connection 72 and the electrical connection 100 at the left end of the second tube member 94. This construction of the plasma generator 44" further enhances the capability of timing the initiation of the electrical arc and hence the generation of the plasma for igniting the plasma. It should be appreciated that each of the sites 52 associated with each source of electrical voltage can have their associated fuse 74 sized to burn simultaneous with each other or sequentially in addition to the flexibility in timing and the level of power possible by use of the two sources of electrical voltage 48 and 102.

With reference to FIGS. 20 and 21, the cartridge 30 is illustrated as having a single plasma generator 44 which may be of any of the constructions previously described and is mounted by the base end 36 of the cartridge casing which is made of high strength electrically conductive metal and is electrically connected to one terminal of the associated electrical voltage source through a suitable contact for the firing. An electrically conductive metallic base plate 106 is covered with a suitable insulation so as to be electrically isolated from the base end 36 which also has an insulative coating at the interface. An insulation plate 108 of high strength metal has an insulative coating that isolates it from all of the other components and prevents electrical contact between the connectors 70 and 72 of the plasma generator 44. A mounting plate 110 has an electrical insulative coating but is electrically connected to the base end 36 by three sets of bolts 112 and sleeves 114, only one of which set is shown. More specifically, the sleeve 114 is made of a soft electrically conductive metal such as copper and has an outer electrically insulative coating so as to be isolated from the insulation plate 108 and the base end 36 while extending through associated holes 116 and 118 thereof. The opposite ends of the sleeve 114 are bare metal that is electrically contacted with the mounting plate 110 and the base plate 106 with the associated bolt 112 extending through a hole 120 in the mounting plate 110 and is threaded into a hole 122 in the base plate 106 such that the torquing of the bolt effectively establishes the electrical contact. The plasma generator 44 extends through holes 124 and 126 in the insulation and mounting plates 108 and 110 respectively, and has its connector 70 provided with a threaded construction that is received by a threaded hole 124, and at the center of the cartridge base end 36 so as to establish electrical contact. Likewise, the electrical connector 72 is electrically connected to the mounting plate 110 at the hole 126 such as by a press fit. Electrical connectors 70 and 72 can establish the electrical connection either by threaded or press fits as well as any other suitable type of electrical connection that has the capability of withstanding the high electrical current and shock that is present during firing of the cartridge.

With reference to FIGS. 22 and 23, it is also possible for the cartridge 30 to have a plurality of the plasma generators 44 such as the three illustrated with each being mounted by the base end of the cartridge in the same manner previously described in connection with FIGS. 20 and 21 except for the location of mounting being at three circumferentially spaced locations rather than the single central location previously described.

While the best modes for carrying out the invention have been described in detail, those familiar with the art to which this invention relates will recognize various alternative designs and embodiments for carrying out the invention as described by the following claims.

What is claimed is:

1. A plasma generator for an electrothermal gun cartridge, comprising:

an elongated metallic rod member extending along a central axis of the plasma generator;

an elongated metallic tube member that extends around the rod member in a spaced relationship thereto and a coaxial relationship therewith, and the tube member having at least one axial gap along the length thereof; and an elongated annular insulator of synthetic resin located between and in engagement with both elongated metallic members such that an electrical voltage applied along the tube member generates an electrical arc at the axial gap thereof to provide a plasma while the insulator and the rod member provide support for the tube member.

2. A plasma generator for an electrothermal gun cartridge as in claim 1 wherein the axial gap has a fuse that burns away when the voltage is applied to the tube member to facilitate the generation of the electrical arc and hence the plasma.

3. A plasma generator for an electrothermal gun cartridge as in claim 1 or 2 which includes a plurality of the axial gaps for generating separate electrical arcs at axially spaced locations from each other.

4. A plasma generator for an electrothermal gun cartridge as in claim 3 wherein the axial gaps are constructed to provide simultaneous generation of the separate electrical arcs at the axial gaps.

5. A plasma generator for an electrothermal gun cartridge as in claim 3 wherein the axial gaps are constructed to provide sequential generation of the separate electrical arcs at the axial gaps.

6. A plasma generator for an electrothermal gun cartridge as in claim 5 wherein the insulator completely insulates the elongated metallic members from each other at the axial gaps such that there is no electrical arcing therebetween as the electrical arcs are established at the axial gaps.

7. A plasma generator for an electrothermal gun cartridge as in claim 1 or 2 wherein the tube member has generally helically extending portions of opposite pitch at opposite sides of the axial gap to cause a rotational movement of the electrical arc.

8. A plasma generator for an electrothermal gun cartridge as in claim 7 which includes a plurality of the axial gaps and associated helically extending portions.

9. A plasma generator for an electrothermal gun cartridge as in claim 1 or 2 further including a second elongated metallic tube member that receives the first mentioned elongated metallic tube member in a spaced relationship thereto and a coaxial relationship therewith, a second elongated annular insulator of synthetic resin located between and in engagement with both elongated metallic tube members, and said second elongated metallic tube member having at least one axial gap for generating an electrical arc to provide a plasma when an electrical voltage is applied along its length.

10. A plasma generator for an electrothermal gun cartridge as in claim 9 wherein the first and second elongated metallic tube members each include a plurality of the axial gaps.

11. A plasma generator for an electrothermal gun cartridge, comprising:

an elongated metallic rod member extending along a central axis of the plasma generator;

an elongated metallic tube member that extends around the rod member in a spaced relationship thereto and a coaxial relationship therewith, said tube member having a plurality of axial gaps along the length thereof, and each axial gap having a fuse; and an elongated annular insulator of synthetic resin located between and in engagement with both elongated metallic members such that an electrical voltage applied along the tube member burns away the fuses thereof and generates an electrical arc at each axial gap thereof to provide a plasma while the insulator and rod member provide support for the tube member.

* * * * *

UNITED STATES PATENT AND TRADEMARK OFFICE
CERTIFICATE OF CORRECTION

PATENT NO. : 5,549,046

DATED : August 27, 1996

INVENTOR(S) : Melvin M. Widner, et al.

It is certified that error appears in the above-identified patent and that said Letters Patent is hereby corrected as shown below:

Column 2, Line 27, (Amendment dated November 6, 1995, Page 4, Line 15), before "having" delete "metallic";

Column 5, Line 4 (Appln. Page 10, Line 34), change "coaxially" to --coaxial--;

Column 5, Line 34 (Appln. Page 12, Line 1), before "and" insert --copper--;

Column 6, Line 30 (Appln. Page 14, Line 1), change "sequentially" to --sequential--;

Column 7, Line 33 (Appln. Page 16, Line 9), change "view" to --viewed--;

Column 8, Line 23 (Appln. Page 18, Line 5), change "engagement" to --engaged--;

Column 9, Line 20, (Amendment dated April 13, 1995, Page 20, Line 5), change "124" to --124'--.

Signed and Sealed this

Eleventh Day of March, 1997

*Attest:*

Bruce Lehman

BRUCE LEHMAN

*Attesting Officer*

*Commissioner of Patents and Trademarks*